US005692393A

United States Patent [19]

Klintworth et al.

[11] Patent Number: 5,692,393

[45] Date of Patent: Dec. 2, 1997

[54] INTERNALLY FIRED GENERATOR

[75] Inventors: Michael W. Klintworth, Covington; U. Tina Kim, Dayton, both of Ohio

[73] Assignee: Gas Research Institute, Chicago, Ill.

[21] Appl. No.: 478,981

[22] Filed: Jun. 7, 1995

[51] Int. Cl.[6] ..... F25B 15/00

[52] U.S. Cl. ..... 62/497; 62/495; 62/101

[58] Field of Search ..... 62/497, 476, 495, 62/101, 141

[56] References Cited

U.S. PATENT DOCUMENTS

| | | | |
|---|---|---|---|
| 3,254,507 | 6/1966 | Whitlow | 62/476 |
| 3,284,610 | 11/1966 | Grubb | 219/279 |
| 3,295,334 | 1/1967 | Hultgren | 62/148 |
| 3,323,323 | 6/1967 | Phillips | 62/497 |
| 3,407,625 | 10/1968 | McDonald | 62/476 |
| 3,580,013 | 5/1971 | Ballard | 62/148 |
| 3,648,481 | 3/1972 | Ando et al. | 62/236 |
| 3,828,575 | 8/1974 | Mallosky et al. | 62/476 |
| 5,230,225 | 7/1993 | George, II et al. | 62/476 |

*Primary Examiner*—William Doerrler

*Attorney, Agent, or Firm*—McAndrews, Held & Malloy, Ltd.

[57] ABSTRACT

An absorption refrigeration system generator is disclosed which has an internal fire tube or combustion chamber for heating a composite fluid refrigerant. The fire tube includes at least one radially projecting heat transfer member on its interior surface for interaction with hot combustion gases. The generator is connected to a leveling chamber for maintaining a minimum quantity of fluid refrigerant in the generator. The leveling chamber comprises a reservoir connected to facilitate substantial equilibrium of the fluid levels within the generator and reservoir. The reservoir holds a quantity of weakened refrigerant solution flowing from the generator. A conduit within the reservoir transfers the weakened solution within the reservoir to the absorber under normal operating conditions. In the event the refrigerant level within the generator drops below a predetermined level, fluid flow out of the reservoir ceases. Thus, the generator fluid refrigerant level is prevented from dropping substantially below the predetermined level.

8 Claims, 2 Drawing Sheets

INTERNALLY FIRED GENERATOR

FIELD OF THE INVENTION

This invention relates generally to absorption refrigeration systems and, more particularly, concerns an improved generator cooperating with a reservoir for maintaining a minimum level of refrigerant solution within the generator.

BACKGROUND OF THE INVENTION

Absorption refrigeration, chilling, heat pump, and related apparatus employing a composite refrigerant and a single refrigeration loop is well known. The refrigeration loop includes a generator, a condenser, an evaporator, and an absorber. A variety of composite refrigerant fluids can be used in such apparatus. Two examples are an ammonia/water solution and a lithium bromide/water solution. Such refrigerants are distillable in the generator, forming a more-volatile component and a less-volatile component. The less-volatile refrigerant component is referred to as a weak refrigerant solution. The two-component composite refrigerant is called a strong refrigerant solution.

FIG. 1 is a block diagram of a known absorption refrigeration system. The following description briefly explains the functions of its various components.

As shown in FIG. 1, conventional absorption refrigeration systems include a generator 10, an absorber 12, a condenser 14, an evaporator 18, a heat lead 20 and a heat sink 16. In operation, heat from an external source of energy is added to the composite refrigerant in the generator 10. The generator 10 heats the composite liquid refrigerant sufficiently to distill out a vapor of the more volatile component or phase of the refrigerant (for example, ammonia vapor in the case of the ammonia/water refrigerant and water in the case of the lithium bromide/water system), leaving a less-volatile component or phase of the refrigerant behind. The less-volatile refrigerant component can either be more concentrated than the composite refrigerant (as when water vapor is distilled out of an aqueous lithium bromide solution) or more dilute than the initial refrigerant (as when ammonia is driven out of water solution). The remaining less-volatile refrigerant component is removed to the absorber 12.

The condenser 14 receives the vapor phase of the refrigerant from the generator 10 and condenses it to liquid form (also known as a condensate). The heat released by the condensation of the vapor is rejected to a cooling tower, cooling water, some other external heat sink 16, or another stage of the refrigeration apparatus.

The evaporator 18 withdraws heat from a heat load 20 (i.e. the building air, refrigerator contents, cooling water, or other medium the system is designed to cool) by evaporating the condensed liquid refrigerant in direct or indirect heat exchange contact with the heat load 20. The evaporator 18 thus re-vaporizes the volatile refrigerant component.

The absorber 12 combines the refrigerant vapor component leaving the evaporator 18 with the less-volatile, weak refrigerant component leaving the generator 10. The contacting process generates heat when the vapor phase is reabsorbed into the less-volatile refrigerant phase. This heat is rejected to a cooling tower, cooling water, another stage of the refrigeration apparatus, or some other heat sink 16. The original composite refrigerant is re-formed in the absorber 12, and then is returned to the generator 10 as strong refrigerant solution to complete the cycle.

In absorption refrigeration systems, a number of conditions may be encountered which undesirably lower the composite refrigerant level in the generator. This condition is especially likely when the system is started up, if a pump or composite refrigerant transfer device malfunctions, or if the composite refrigerant is delayed in reaching the generator. When the composite refrigerant level in the generator is too low, the generator can quickly overheat. To prevent a low refrigerant level and the resulting overheating of the generator, temperature sensing devices or electronic control circuits have been employed. One example of an electronic generator level control is disclosed in U.S. Pat. No. 3,580,013.

SUMMARY OF THE INVENTION

The invention relates to an absorption refrigeration system comprising a generator, condenser, evaporator, absorber, and a leveling chamber. The leveling chamber acts to maintain a minimum quantity of fluid refrigerant in the generator to prevent overheating. The minimum level is predetermined by positioning a conduit within the leveling chamber.

The invention also discloses an internal heat source for the generator. The heat source comprises a fire tube including a burner and internal, radially projecting heat exchange fins.

The disclosed system provides several advantages over the prior art. Insulating the entire generator assembly is simplified because the heat source is internalized, resulting in less heat loss and higher efficiency than externally-heated generators. Locating the heat exchange fins within the fire tube also reduces corrosion because less surface area is exposed to the surrounding refrigerant solution. Furthermore, the condition resulting in low refrigerant solution level within the generator has been eliminated, and generator efficiency improved. In addition, the simplified structure of the present apparatus will result in less cost than previous level-maintaining systems.

REFERENCE CHARACTER LIST

Figure 1:
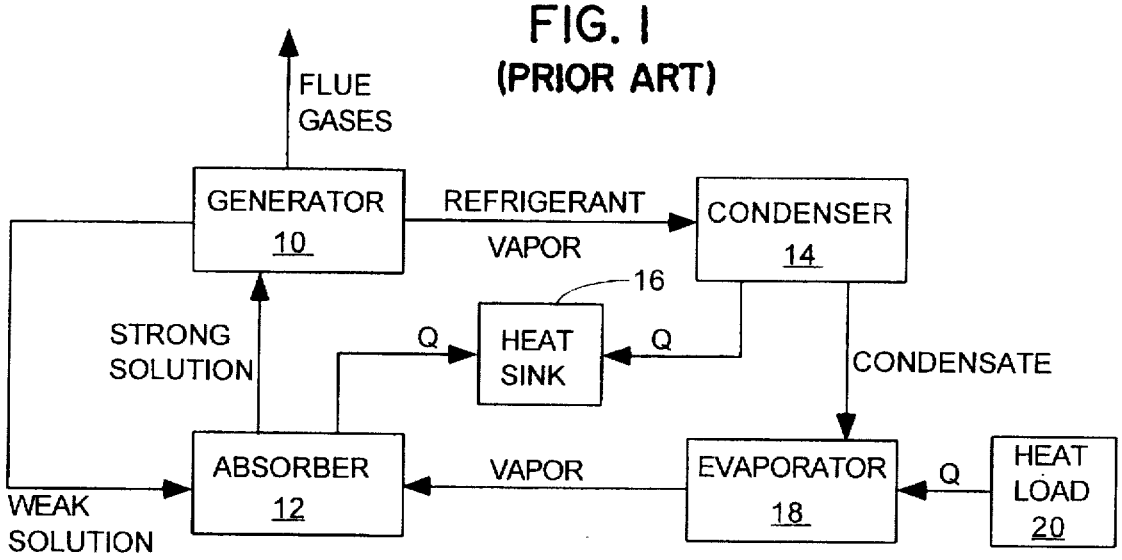
FIG. 1 (PRIOR ART)
FIG. 1 is a block diagram of an absorption refrigeration system.

10 generator
12 absorber
14 condenser
16 heat sink
18 evaporator
20 heat load
22 vessel
24 rectifier
26 boiler section
28 generator inlet conduit
30 generator inlet conduit
32 reflex coil
33 coolant reservoir
34 ring packing
36 vapor outlet
37 vapor conduit 38 internal fire tube
40 baffle coil
41 fluid conduit
42 burner
44 heat exchange fins
46 insulation center plug
48 flue gas outlet
50 fluid inlet
52 fluid outlet
54 leveling chamber
56 conduit
58 conduit inlet

DETAILED DESCRIPTION OF THE INVENTION

While the invention will be described in connection with one or more preferred embodiments, it will be understood that the invention is not limited to those embodiments. On the contrary, the invention includes all alternatives, modifications, and equivalents as may be included within the spirit and scope of the appended claims.

Figure 2:
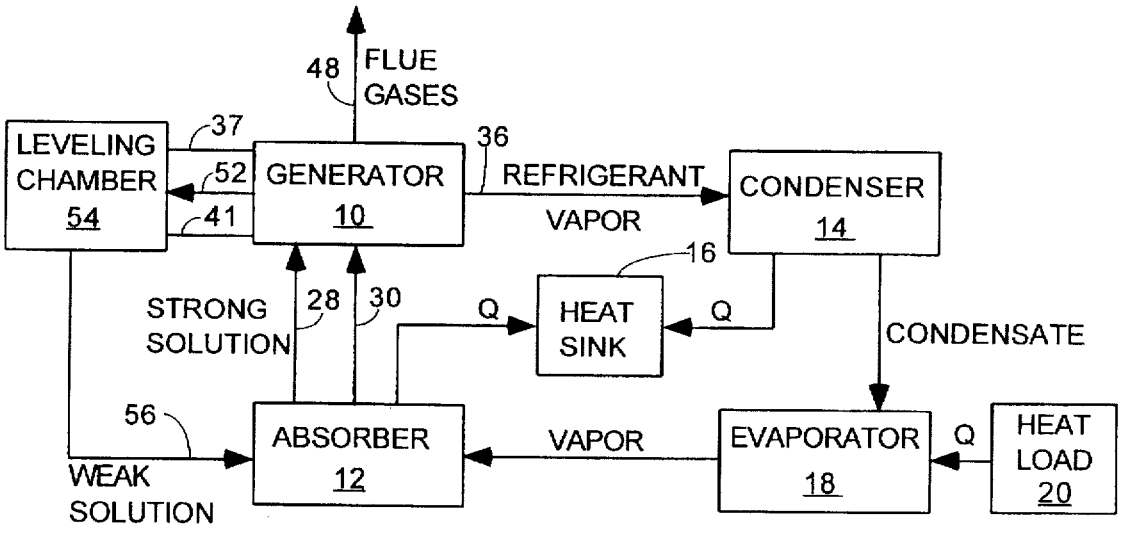
FIG. 2 is a block diagram of an absorption refrigeration system including the generator and leveling chamber apparatus of the present invention.
Figure 3:
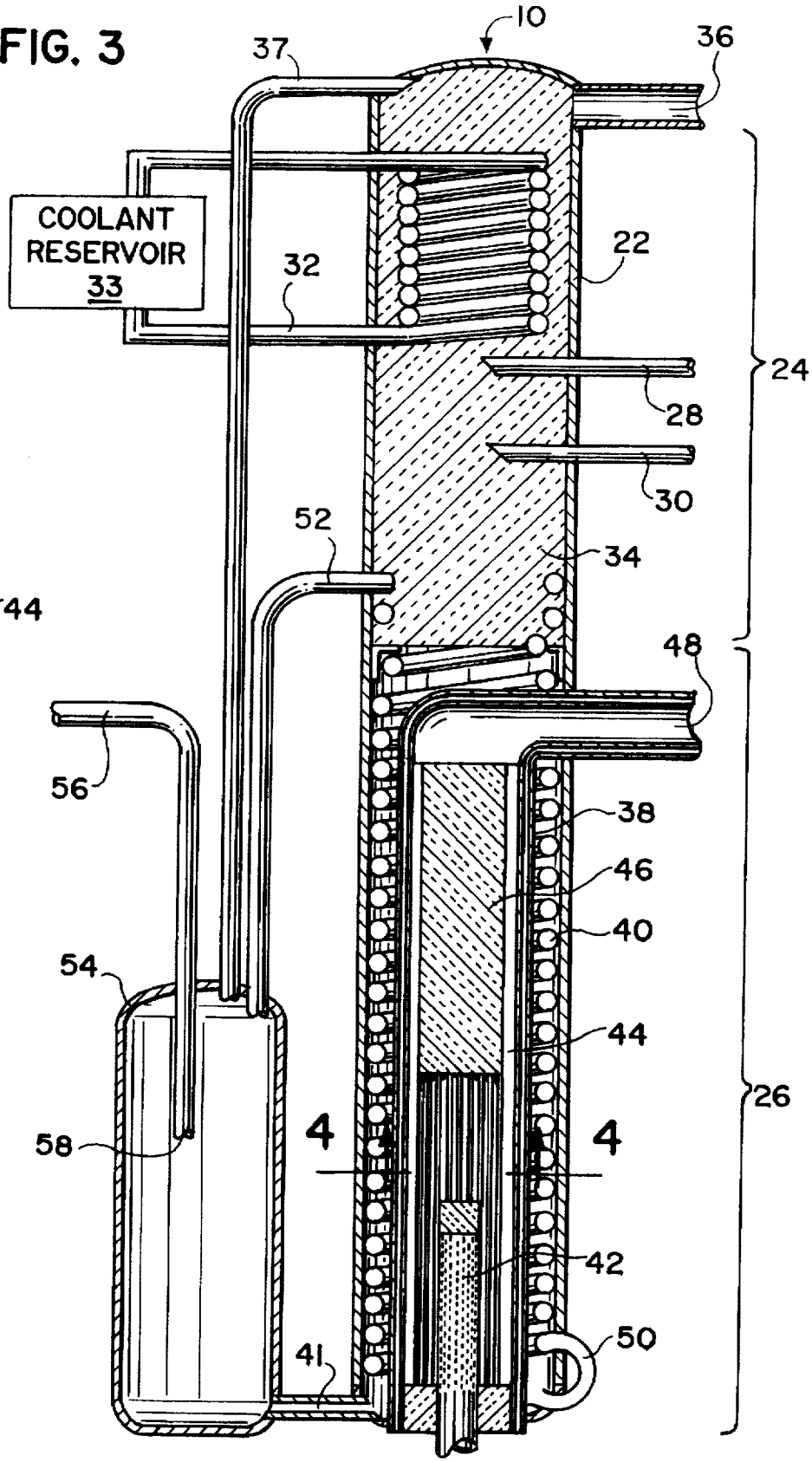
FIG. 3 is a diagrammatic longitudinal section of the generator and leveling chamber apparatus according to the present invention.

FIGS. 2 and 3 show one embodiment of an absorption refrigeration system including the generator and leveling chamber apparatus of the present invention. The generator 10 comprises a generally vertically oriented generator vessel 22 that is divided generally into an upper portion or rectifier 24 and a lower portion or boiler section 26.

The rectifier 24 includes one or more generator inlet conduits 28, 30, a reflux coil 32, and a ring packing 34. The reflux coil 32 communicates with a coolant reservoir 33. The rectifier 24 further comprises a vapor outlet 36 and vapor conduit 37.

Figure 4:
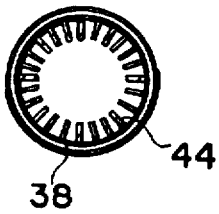
FIG. 4 is a sectional view taken at line 4—4 of FIG. 3.

The boiler section 26 includes an internal fire tube 38, a baffle coil 40, and a fluid conduit 41. The internal fire tube 38 comprises a heat source or burner 42, radial vertical heat exchange fins 44 (also shown in FIG. 4), an insulation center plug 46, and a flue gas outlet 48. The baffle coil 40 comprises a closely spaced helical spiral tube with a fluid inlet 50 and a fluid outlet 52.

The reservoir or leveling chamber 54 is connected to the generator assembly 10 by the vapor conduit 37, the fluid conduit 41, and fluid outlet 52. The leveling chamber includes a conduit 56 with an inlet 58.

In operation, the generator assembly 10 functions as a fractional distillation column, separating the non-volatile component, such as ammonia, from the less-volatile compound of the composite refrigerant solution. Accordingly, the generator rectifier 24 receives composite fluid refrigerant through one or more generator inlet conduits 28 and 30. As shown in FIG. 2, the fluid refrigerant entering the generator inlet conduits 28 and 30 is a strong refrigerant solution, having come from the absorber 12. Referring to FIG. 3, the incoming strong refrigerant solution contacts and trickles through the ring packing 34 into the boiler section 26.

Throughout the generator 10, but particularly within the boiler section 26, the strong refrigerant solution is heated to distill out the volatile phase of the refrigerant. Heat is added to the refrigerant solution by the internal fire tube 38. Within the fire tube 38, the burner 24 creates heat by burning a fuel such as natural gas. Hot combustion gases from the burner 24 flow upward outside the insulation center plug 46. The insulation center plug 46 forces the hot combustion gases into contact with the heat exchange fins 44 (also shown in FIG. 4) and against the interior surface of the fire tube 38. Thus, the refrigerant solution contacting the exterior surface of the fire tube 38 is heated. Combustion gases exit the fire tube 38 at the flue gas outlet 48.

The internal heat exchange fins 44 of the fire tube 38 provide several advantages. For example, insulation of the entire generator assembly 10 is made easier because the heat source is surrounded by the fire tube 38, the refrigerant solution within the boiler section 26, the baffle coil 40, and the generator vessel 22. This results in less heat loss and higher efficiency. Further, heat transfer to the exterior surface of the fire tube 38 is increased because the most surface area is provided on the flue gas side, where heat transfer is less efficient than on the refrigerant side. Also, corrosion is reduced on the exterior surface of the fire tube 38 because there is less surface area contacting the refrigerant solution. (In some instances the refrigerant solution may be corrosive.)

As the refrigerant solution is heated in the boiler section 26, the volatile phase is distilled out of the solution. This volatile phase rises through rectifier 24. In the rectifier 24, the ring packing 34 aides in the distillation process by providing multiple surfaces of varying temperature. In this case, the upper portion of the rectifier 24 is cooler than the lower portion. The surfaces created by the ring packing 34 help condense the less-volatile phase of the composite refrigerant, which then trickles downward to insure the purity of the volatile refrigerant vapor exiting the generator 10 through the vapor outlet 36. The reflux coil 32 also acts as a heat sink to condense the less-volatile phase of the composite refrigerant solution increasing the efficiency of phase separation. Thus, in the case of an ammonia/water solution, water will be removed from the ammonia vapor as it rises through the rectifier 24 to the vapor outlet 36.

As shown in FIG. 2, the vapor can then pass to a condenser 14 and evaporator 18 for use in refrigeration. However, as the vapor is distilled, weakened refrigerant solution remains in the boiler section 26.

Referring to FIG. 3, the weakened refrigerant solution exits the boiler section 26 via the baffle coil 40. The baffle coil 40 is located adjacent the inner surface of the generator vessel 22. The closely spaced, helical spiral design of the baffle coil 40 serves several functions. It provides an additional heat exchange between the cooler, incoming strong refrigerant solution and the warmer, exiting weak solution. The baffle coil 40 also aides in mixing the vapors migrating toward the rectifier 24 with solution trickling into the boiler section 26 by acting as a baffle. Weakened refrigerant solution in the boiler section 26 enters the baffle coil 40 through a fluid inlet 50 which communicates with the weak refrigerant solution in the boiler section 26. Pressure in the generator 10, convection due to heating of the contents of the coil 40, and siphoning cause the weakened refrigerant solution to travel upward through the baffle coil 40 and exit the generator at the fluid outlet 52. From the fluid outlet 52 the weakened refrigerant solution enters the leveling chamber 54.

The leveling chamber 54 is connected to the lower portion of the boiler section 26 by the fluid conduit 41, and to the upper portion of the rectifier 24 by the vapor conduit 37. The fluid conduit 41 communicates with the weak refrigerant solution in the boiler section 26, as does the fluid inlet 50. However, the inside diameters of the fluid conduit 41 and the vapor conduit 37 are much smaller than the inside diameter of the baffle coil 40. This difference restricts the flow of solution through the fluid conduit 41 and the flow of vapor through the vapor conduit 37 into the leveling chamber 54, providing a path of less resistance through the baffle coil 40, via the fluid inlet 50. The fluid conduit 41 and vapor vent 37 equalize pressure between the vessel 22 and the leveling chamber 54, so the fluid level in each of them will tend to equalize.

As shown in FIG. 2, the weak refrigerant solution exits the leveling chamber 54 through the conduit 56 and returns to the absorber 12. Referring to FIG. 3, lower pressure downstream draws the weak refrigerant solution into the conduit 56 through the conduit inlet 58. Therefore, the weak refrigerant solution will only exit the leveling chamber 54 when the solution level is higher than the conduit inlet 58. Since the fluid levels within the generator vessel 22 and the leveling chamber 54 are substantially equal, the minimum fluid level within the generator vessel 22 normally will be above the conduit inlet 58. Thus, the refrigerant fluid level within the vessel 22 will be maintained no lower than the opening of the conduit inlet 58. If the refrigerant solution level within the vessel 22 drops below the conduit inlet 58, weak refrigerant fluid flow out of the leveling chamber 54 will stop until the fluid level in the vessel 22 rises above the level of the conduit inlet 58 in the leveling chamber 54. Accordingly, the generator vessel 22 will maintain a minimum amount of refrigerant solution at all times.

Many other variations will suggest themselves to one of ordinary skill in the art. These changes and additions may be carried out without departing from the present invention. For example, the leveling chamber 54 could be any height, volume, or size depending upon the refrigerant solution turnover rate within the generator. A high turnover rate, with associated higher heat, may require a larger capacity leveling chamber and/or higher conduit inlet to avoid overheating the generator. Likewise, the height, width, or volume of the generator vessel 22 will vary with the application or composite fluid refrigerant used.

Another embodiment may alter or eliminate the helical baffle coil 40 and corresponding fluid outlet 52. The fluid conduit 41 and vapor conduit 37 could be enlarged to more quickly reach equilibrium between the fluid levels within the generator vessel 22 and leveling chamber 54.

In addition, it is readily apparent that the leveling chamber concept of the present invention could be used with most conventional generators presently available. Likewise, many heat sources currently available could be substituted for the internal fire tube design of the present invention.

Accordingly, many other expedients will readily suggest themselves to one of one of ordinary skill of the art, in view of the foregoing disclosure.

Thus, an internally fired generator apparatus has been shown which has simplified construction and lower maintenance than previous systems. It is expected that this apparatus will typically be more efficient than prior apparatus, and will cost less, and waste less heat than prior apparatus. The condition resulting in low refrigerant solution level within the generator has been eliminated. Furthermore, the generator heat source and efficiency has been improved. Thus, one or more objects of the present invention have been met by the illustrated apparatus.

What is claimed is:

1. An absorption refrigeration system comprising: generator including a lower portion for receiving a column of fluid refrigerant, an upper portion defining a rectifier; a condenser an evaporator an absorber; and a leveling chamber for maintaining a minimum quantity of fluid refrigerant in said generator at a predetermined point; said leveling chamber comprising:

(a) a reservoir;

(b) a first conduit disposed below said predetermined point and allowing fluid communication between said reservoir and said generator;

(c) a second conduit communicating between said rectifier and said reservoir and allowing pressure equalization between said reservoir and said generator; and, (d) a third conduit allowing fluid communication between said reservoir and said absorber, said third conduit having an inlet located within said reservoir, said first and second conduits facilitating equilibrium of vapor and fluid pressures in said generator and reservoir, said inlet of said third conduit positioned such that weakened refrigerant solution from said reservoir flows into said inlet and through said third conduit to said absorber only when said fluid refrigerant level within said generator is above the inlet of said third conduit, thereby preventing said generator fluid refrigerant level from dropping substantially below said predetermined point.

2. The apparatus according to claim 1, wherein said first conduit communicates between the lower portion of said reservoir and the lower portion of said generator.

3. The apparatus according to claim 1, wherein said second conduit communicates between the upper portion of said reservoir and the upper portion of said generator.

4. An absorption refrigeration system vapor generator and burner unit comprising:

a substantially enclosed vessel having a wall defining an interior surface, a lower and an upper portion, at least one inlet for receiving a concentrated refrigerant solution, and at least one outlet for exhausting refrigerant vapors;

a fire tube having a wall defining an interior surface, an exterior surface, a lower and an upper portion said fire tube located within said lower portion of said vessel, said fire tube having at least one radially projecting heat transfer member on said interior surface of said fire tube for interaction with hot combustion gases, said heat transfer member comprising a plurality of metallic fins;

a burner for burning a fuel said burner located within said lower portion of said fire tube; and an outlet conduit connected to said fire tube for exhausting combustion gases outside said vessel;

wherein said upper portion of said tube member contains a quantity of insulation for forcing said combustion gases against said heat transfer members and said interior surface of said fire tube.

5. An absorption refrigeration system vapor generator and burner unit comprising:

a substantially closed vessel having a wall defining an interior surface, a lower and an upper portion at least one inlet for receiving a concentrated refrigerant solution, and at least one outlet for exhausting refrigerant vapors;

a fire tube having a wall defining an interior surface an exterior surface a lower and an upper portion, said fire tube located within said lower portion of said vessel, said fire tube having at least one radially projecting heat transfer member on said interior surface of said fire tube for interaction with hot combustion gases;

a burner for burning a fuel said burner located within said lower portion of said fire tube;

an outlet conduit connected to said fire tube for exhausting combustion gases outside said vessel;

a helical baffle coil spaced apart from and opposing said exterior of said fire tube, said baffle coil located adjacent said interior surface of said vessel, said baffle coil including an inlet and an outlet for transferring weakened refrigerant solution exterior to said vessel;

a leveling chamber for maintaining a minimum quantity of fluid refrigerant in said generator vessel, wherein said leveling chamber comprises:

(a) a reservoir;

(b) a first conduit allowing communication of said weakened refrigerant solution between said reservoir and said generator unit;

(c) a second conduit communicating between said upper portion and said reservoir and allowing pressure equalization between said reservoir and said generator; and, (d) a third conduit allowing fluid communication between said reservoir and an absorber, said third conduit having an inlet located within said reservoir, said first and second conduits facilitating equilibrium of vapor and fluid pressures in said generator vessel and said reservoir, said inlet of said third conduit positioned such that said weakened refrigerant solution flows from said third conduit of said reservoir to said absorber only when the fluid level within said generator vessel is above the inlet of said third conduit.

6. The generator unit according to claim 5, wherein said inlet of said third conduit is positioned at a height substantially equal to the vertical height of said fire tube, thereby maintaining a quantity of refrigerant solution within said vessel substantially equal to the height of said fire tube.

7. The generator unit according to claim 5, further comprising an inlet in said reservoir for receiving said weakened refrigerant solution from said outlet of said baffle coil.

8. A method of maintaining a minimum quantity of fluid refrigerant within a refrigerant vapor generator at a predetermined point, said method comprising the steps of:

(a) providing a generator, a reservoir, and an absorber, said generator including a column of fluid, a rectifier, and a surface dividing said column and said rectifier, (b) reserving a quantity of fluid within said reservoir, said fluid flowing from said generator;

(c) equalizing the vapor pressure and fluid level between said reservoir and said generator, said reservoir including a vessel with an outlet conduit having an inlet located interior of said vessel; and, (d) adapting said inlet of said reservoir such that said fluid flows from said reservoir to said absorber only when said surface level within said generator is above said inlet, thereby preventing said generator fluid refrigerant level from dropping substantially below said point.

* * * * *